US005109809A

United States Patent [19]

Fujimoto

[11] Patent Number: 5,109,809

[45] Date of Patent: May 5, 1992

[54] TEMPERATURE CONTROL SYSTEM FOR A WATER-COOLED INTERNAL COMBUSTION ENGINE

[75] Inventor: Hiroaki Fujimoto, Hamamatsu, Japan

[73] Assignee: Sanshin Industries Co., Ltd., Hamamatse, Japan

[21] Appl. No.: 662,258

[22] Filed: Feb. 28, 1991

[30] Foreign Application Priority Data

Feb. 28, 1990 [JP] Japan ..... 2-45640

[51] Int. Cl.[5] ..... F01P 1/06

[52] U.S. Cl. ..... 123/41.31; 123/41.08; 123/540

[58] Field of Search ..... 123/41.01, 41.02, 41.08, 123/41.13, 41.31, 41.72, 195 C, 195 P, 196 AB, 73 A, 73 V, 540, 542

[56] References Cited

U.S. PATENT DOCUMENTS 1,958,156 5/1934 Whelan ..... 123/196 AB

*Primary Examiner*—Noah P. Kamen

*Attorney, Agent, or Firm*—Ernest A. Beutler

[57] ABSTRACT

A temperature control system for a water-cooled internal combustion engine suitable for use on outboard motors and the like. A water pathway extends along two water-jacketed engine portions. A water supply control means allows a water supply to be selectively directed into one of two possible flow paths within the water pathway. In one flow path direction the water supply is warmed as it passes through the first water-jacketed engine portion so that heated water then passes on to warm the engine in the vicinity of the second water-jacketed engine portion. In the other flow path direction, cool water first passes through the second water-jacketed engine portion and then passes on to the first water-jacketed engine portion, thereby cooling the regions in proximity to both water-jacketed compartments.

19 Claims, 3 Drawing Sheets

TEMPERATURE CONTROL SYSTEM FOR A WATER-COOLED INTERNAL COMBUSTION ENGINE

BACKGROUND OF THE INVENTION

This invention relates to a water-cooled internal combustion engine, and more particularly to an improved temperature control system for such an engine.

The use of water cooled internal combustion engines are well known. Frequently these engines comprise a plurality of cooling jackets surrounding various portions of the engine and through which cooling water is circulated in a predetermined pattern. One reason for using separate cooling jackets is that some components of the engine require greater cooling than others. For example, the cylinder head generally provides a greater heat load than the cylinder block. Therefore, it has been the practice to provide separate cooling jackets for the cylinder head and cylinder block that are interconnected in a flow path. Normally the cold water is first delivered to the cylinder head and then passes to the cylinder block.

Although these arrangements are highly satisfactory, frequently the cooling requirements of different components of the engine can vary during the running condition of the engine. For example, in the induction system it is desirable to provide a low temperature when running at high speeds and high loads. Such cooling improves the volumetric efficiency. On the other hand, when running at low speeds and low loads and under low ambient temperatures, excessive cooling of the induction system can cause condensation and poor fuel economy. These problems are particularly acute in two cycle crankcase compression internal combustion engines.

In two-cycle crankcase compression internal combustion engines, the fuel/air charge is drawn into the crankcase and is compressed during the stroke of the piston for transfer to the combustion chamber through one or more transfer or scavenge passages that interconnect the crankcase with the portion of the cylinder bore above the piston at certain phases of its stroke. Such engines have the advantage of extreme simplicity and, for that reason, are popular in many applications. However, the long path through which the fuel/air mixture must travel before it enters the combustion chamber presents certain problems. For example, when operating at low temperatures and under certain other operating conditions, there is a tendency for a portion of the fuel to condense from the fuel/air mixture in the crankcase. If this condensed fuel is transferred into the combustion chamber through the transfer or scavenge passages, the fuel/air mixture is irregular in strength and poor running can occur. These problems are particularly acute under idle, low speed, acceleration and deceleration conditions.

Thus, it is clear that there are advantages to heating the induction system and crankcase when operating at low ambient temperatures, low loads and low speeds. However, the heating of the induction system and the crankcase chamber in a two cycle engine will adversely affect the fuel economy and power output of the engine when operating at high speeds, high loads and normal temperatures.

It is therefore, an object of this invention to provide a liquid cooling system for an engine wherein certain portions are cooled more rapidly than others under some running conditions and those same certain portions are heated more rapidly under other running conditions.

It is an object of this invention to provide a temperature control system for an internal combustion engine which prevents the formation and accumulation of condensates in the crankcase chamber or in the transfer or scavenge passages.

It is a further object of this invention to improve the output of an internal combustion engine by increasing the air charge amount into the combustion chamber within its high load operation range and/or to stabilize combustion by promoting carburetion of fuel within its low load operation range.

SUMMARY OF THE INVENTION

A first feature of this invention relates to a temperature control system for a liquid cooled internal combustion engine. A water pathway extends along two water-jacketed engine portions. A water supply control means selectively directs water into one of two possible flow paths within the water pathway. A first flow path leads initially to a first water jacket located around a first engine portion and subsequently to a second water jacket located around a second engine portion. A second flow path leads initially to the second water jacket around the second engine portion and subsequently to the first water jacket around the first engine portion.

Another feature of this invention is adapted to be embodied in a liquid cooling system for a two cycle crankcase compression internal combustion engine having a cylinder block cylinder head assembly and a crankcase assembly. In accordance with this feature of the invention, a first cooling jacket encircles the cylinder head cylinder block assembly and a second cooling jacket at least partially encircles the crankcase. Means are provided for circulating coolant through the cooling jackets.

DETAILED DESCRIPTION OF THE PREFERRED EMBODIMENTS

Figure 1:
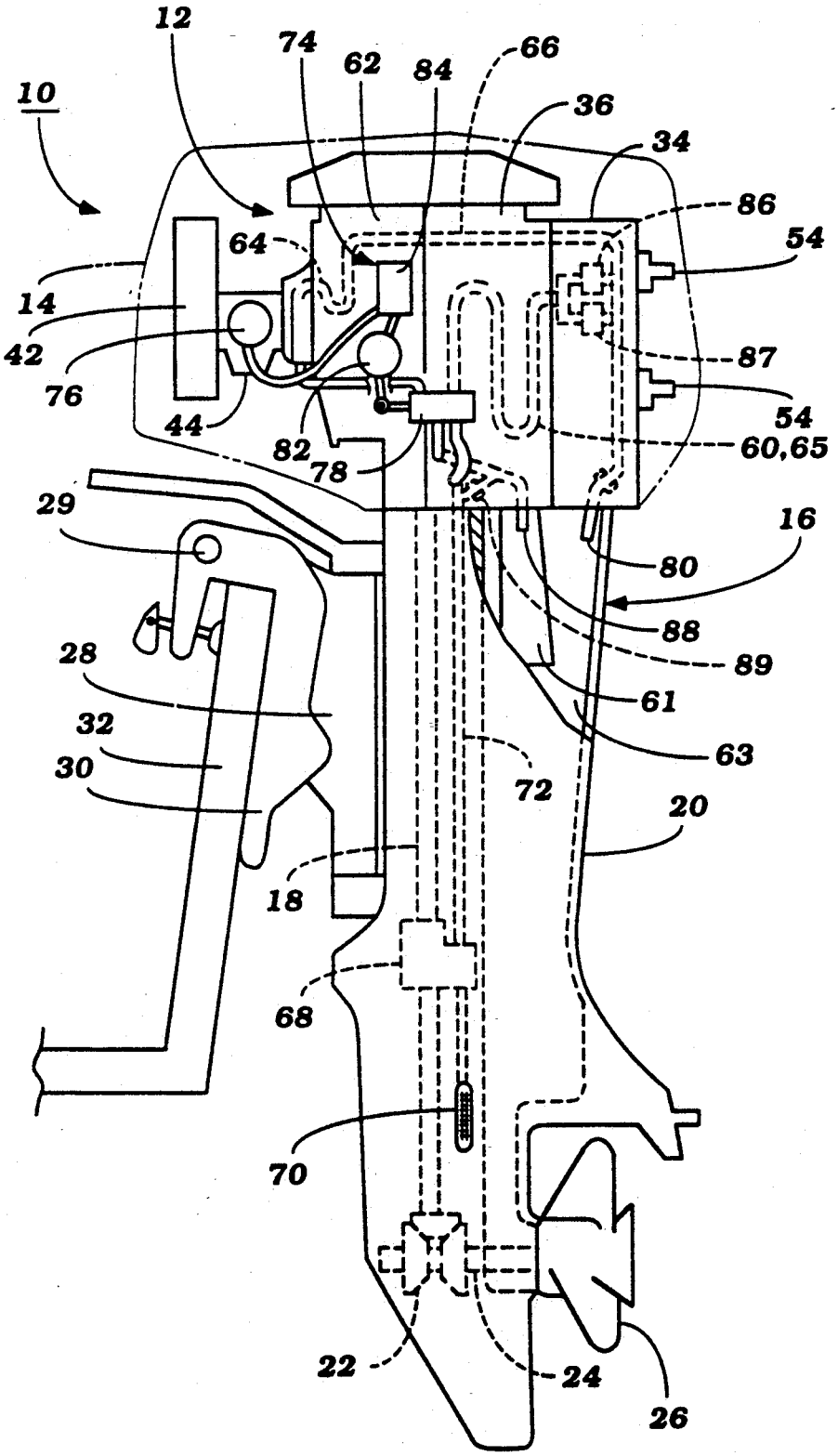
FIG. 1 is a side elevational view of an outboard motor having an internal combustion engine constructed in accordance with the invention, as attached to the transom of a watercraft, with portions broken away and other portions shown in phantom.

Referring to the embodiment of FIG. 1, the power head of an outboard motor is identified generally by the reference numeral 10. The invention is described in conjunction with an outboard motor, however, it is to be understood that it may be employed with other types of applications for internal combustion engines, particularly those of the two-cycle type. An outboard motor is a typical example of an environment wherein the invention has particular utility.

The power head 10 includes an internal combustion engine, indicated generally by the reference numeral 12, which is surrounded by a protective cowling, which is shown primarily in phantom and which is identified generally by the reference numeral 14. The power head is, in turn, carried at the upper end of a driveshaft housing 16 that supports a driveshaft 18 for rotation about a vertically extending axis. The driveshaft 18, in turn, extends through a lower unit 20. A forward, neutral, reverse transmission 22 is positioned within the lower unit 20 for selectively driving a propeller shaft 24 in forward or reverse directions. A propeller 26 is affixed to the propeller shaft 24 in a known manner.

The outboard motor further includes the normal, steering swivel bracket 28 which is pivotally connected by a pivot pin 29 to a clamping bracket 30 for tilt and trim attachment to a watercraft hull transom 32 in a known manner. As has been previously noted, the outboard motor is described only as a typical environment in which the invention can be employed. For that reason, further details of the description of the outboard motor, apart from the engine and its cooling system, are believed to be unnecessary to enable those skilled in the art to practice the invention.

The engine in the illustrated embodiment is a two cylinder, in line engine operating on the two stroke crankcase compression principle. The invention however may be used with other cylinder configurations or numbers, rotary engines or engines operating on other cycles. The invention, however, has particular utility with two cycle, crankcase compression engines.

The engine 12 includes a cylinder head 34 affixed to a cylinder block 36, with a pair of combustion chambers 38 formed therebetween. The arrangement for delivering a fuel/air charge to the combustion chambers 38 will now be described. A fuel/air charge is delivered through an intake manifold 39 to a sealed crankcase chamber 40 for each combustion chamber 38 by means of an induction and charge forming system. This system includes an air inlet device 42 that draws atmospheric air from within the protective cowling 14 and delivers it to a carburetor 44, in a known manner. The carburetor 44 delivers the fuel/air charge to the intake manifold 39 which discharges into the crankcase chamber 40. A reed-type check valve 46 is positioned in the manifold 46 so as to preclude reverse air flow. The fuel/air charge is compressed in the crankcase chamber and is transferred upon descent of a piston 48, on connecting rod 50, into the respective combustion chamber 38 via one or more transfer or scavenge passages 52.

Upon the firing of a spark plug 54, communicating with the combustion chamber 38, the fuel/air charge is ignited, and the gases therein expanded, forcing the piston 48 downward through a cylinder bore 56 formed within the cylinder block 36. The ignition of the fuel/air charge causes the region in proximity to the combustion chamber to heat up considerably.

A cylinder head water jacket 60 is provided around this high operating temperature region of the engine. Thus, liquid coolant may be circulated through the water jacket to carry away excess heat. Further, a wall 62 envelopes the induction manifold 46 and crankcase chamber 40 regions of the engine, thus forming a crankcase cooling jacket 64 which also may accommodate a liquid coolant therein. The liquid coolant may travel in either direction, as desired, between the cylinder head water jacket 60 and the crankcase cooling jacket 64 through a passageway 66.

The burnt exhaust gases are discharged from the combustion chamber 38 through an exhaust port formed in the cylinder block 36 from each of the combustion chambers to an exhaust manifold 59 that is formed integrally within the cylinder block 36. These exhaust gases are then discharged to the atmosphere through a suitable exhaust system, which may include an exhaust pipe 61 (FIG. 1) and expansion chamber 63 formed in the driveshaft housing 20. The exhaust gases are then discharged to the atmosphere through an underwater exhaust gas discharge of any known type under high speed operation and through an above the water low speed exhaust gas discharge (not shown) as is typical with outboard motor practice. The cylinder block 36 and also the exhaust manifold 59 are provided with a cooling jacket, indicated by the reference numeral 65. The cylinder block exhaust manifold cooling jacket 65 is in circuit with the cylinder head cooling jacket 60 and the crankcase cooling jacket 64 in a flow path as will be described.

Figure 3:
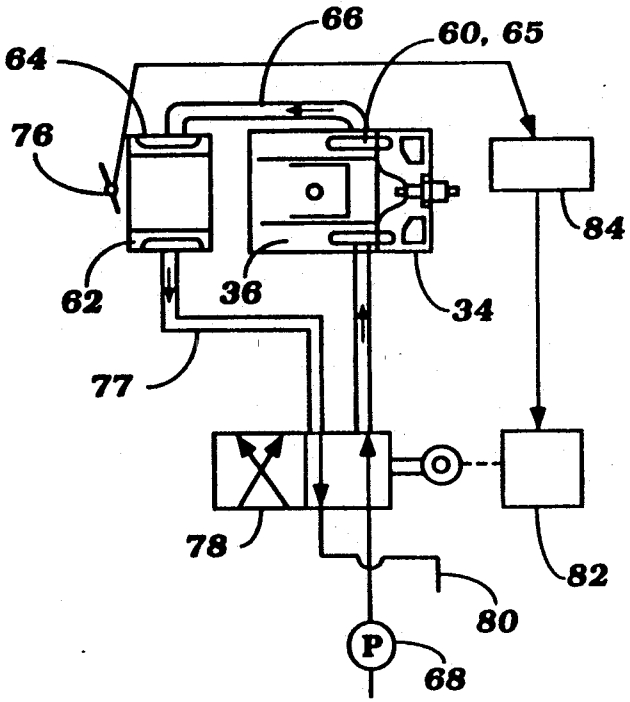

The engine 12 is provided with a liquid cooling system of the water cooled type. The cooling system includes a circulating pump 68 that is driven by the engine 12 of the power head 10 in a suitable manner, for example by the driveshaft 18 which is coupled to the engine crankshaft in a known manner. The cooling system further includes a water intake port 70 that is formed in the lower unit 20 of the outboard motor and which communicates with a water supply passage 72 that is formed within the driveshaft housing 16 and lower unit 20. The water intake port 70 is positioned in the lower unit 20 so that it may be in communication with the body of water within which the watercraft is operating. Water supplied through the water supply passage 72 is moved upward by the water pump 68 towards a water supply control circuit 74, schematically shown in FIGS. 3 and 4. The water supply is then directed into one of two possible flow pathways, depending upon the current engine operating conditions.

Figure 2:
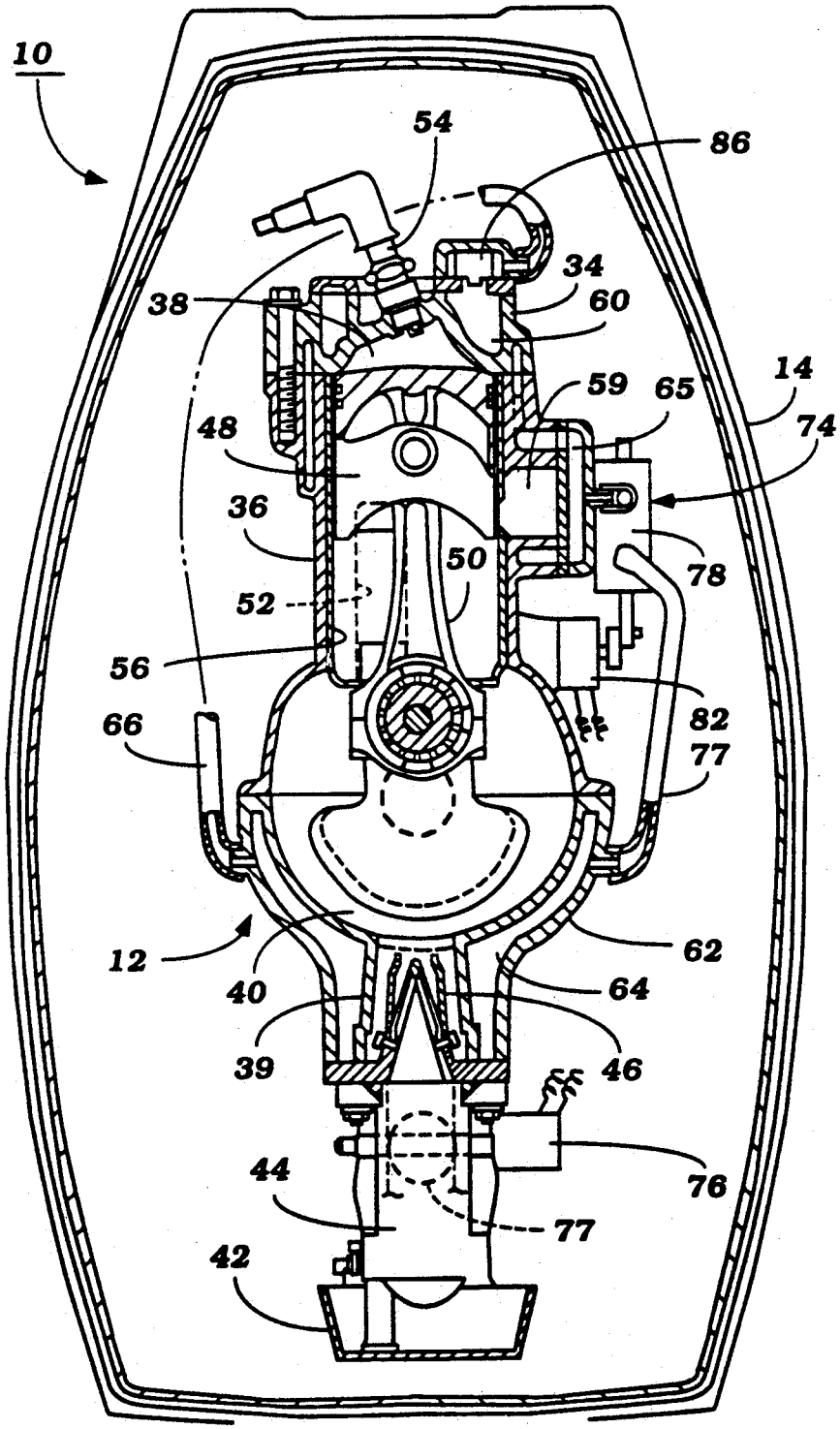
FIG. 2 is an enlarged top plan view of the power head with a portion of the protective cowling removed and parts of the engine broken away and shown in section.

A throttle opening sensor 76 which senses the position of the throttle valve 77 of the carburetor 44 functions as an engine load condition detector. Generally when the engine is operating under a low load condition, as detected by throttle opening sensor 76, the water supply follows the flow path depicted schematically in FIG. 3. This flow path is directed by a switchover valve 78 which is operated so that the water proceeds first into the water jacket 60 formed around the engine combustion chamber 38 and exhaust manifold cooling jacket 65, as shown in FIG. 2. As previously noted, the combustion chamber 38 and exhaust manifold cooling jacket 65 is one of the highest temperature regions in the engine during operation even when the engine is cold. Consequently, as water passes through the water jackets 60 and 65, the water's temperature is elevated. Upon leaving the water jackets 60 and 65 the heated water flows next through the passageway 66 towards, and into, the cooling jacket 64 formed around the engine crankcase chamber 40 and intake manifold 39, shown in FIG. 2. The heated water thus warms the crankcase region of the engine as it flows through the cooling jacket 64. The heating of the crankcase chamber 40 and intake manifold 39 promotes carburetion of the fuel passing through the intake manifold 39 and crankcase chamber 40, helping to prevent the formation and accumulation of condensates and thereby stabilizing combustion. Finally, the water flows again through a conduit 77, to the switchover valve 78 which is positioned so that the water proceeds towards a water exhaust passage 80, shown in FIG. 1, in which a flow restricting orifice 81 is positioned and from which the water is discharged out of the engine into the expansion chamber 63 for discharge back into the body of water in which the outboard motor is operating with the exhaust gases. The water supply control circuit 74 is further provided with a valve operating device such as a servo motor 82 for operating the switchover valve 78, and a control unit such as a CPU 84 for controlling the valve operating device 82 according to the engine load condition detected by the throttle opening sensor 76.

Figure 4:
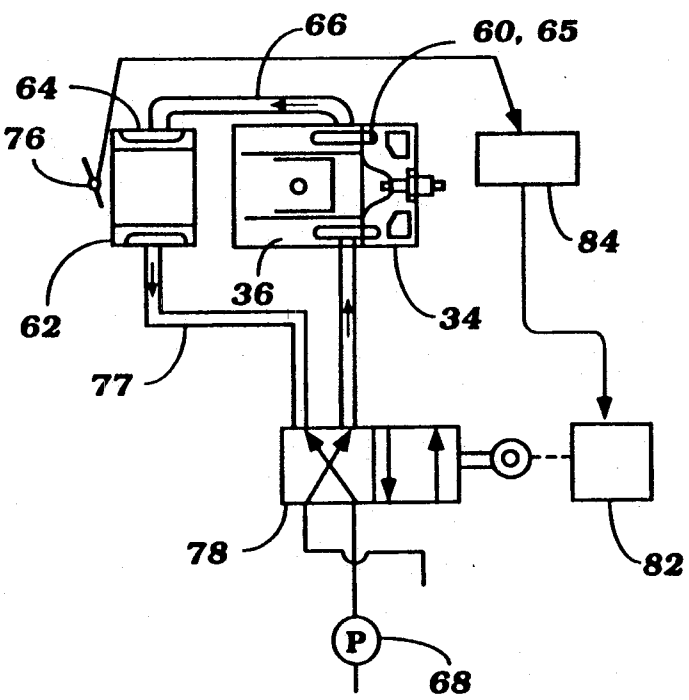
FIGS. 3 and 4 are schematic views of the cooling system for an engine constructed in accordance with the invention under different operating conditions.

When the engine is operating under a high load condition, as detected by the throttle opening sensor 76, the water supply follows the flow path depicted schematically in FIG. 4. In this flow path, the water first flows through the switchover valve 78 which is controlled so that the water proceeds initially through the conduit 77 towards, and into, the water jacket 64 formed around the engine crankcase chamber 40 and intake manifold 39, as shown in FIG. 2. At this point, the water cools the region of the engine in proximity to the cooling jacket 64. Thus, the intake air passing through the crankcase chamber is cooled, which makes the air's density higher. thereby increasing the air charge amount which can be transferred through the scavenge passages 52 and into the combustion chamber 38. Accordingly, engine output is improved. Upon leaving the cooling jacket 64 the water flows next through the passageway 66 towards, and into, the water jacket 60 formed around the engine combustion chamber 38 and the cylinder block exhaust manifold cooling jacket 65, as shown in FIG. 2. At this point, the water cools the region of the engine in proximity to the water jackets 60 and 65. Finally, the water flows from the water jacket 60 through the switchover valve 78 which is positioned so that the water proceeds towards the water exhaust passage 80, shown in FIG. 1, from which the water is discharged out of the engine.

As is typical, the cooling system for the engine 12 also includes a thermostatic valve 86 and a pressure responsive valve 87. The valves 86 and 87 are contained within a well formed in the cylinder head 34 and which communicate with its cooling jacket 60. The conduit 66 communicates the crankcase intake manifold cooling jacket 64 with this well.

When the engine is cold, and it should be noted that the thermostatic valve 86 not only senses coolant temperature but also the temperature of the metal of the cylinder head 34, the thermostatic valve 86 will be closed and no coolant will circulate through the cylinder head cooling jacket 60, cylinder block exhaust manifold cooling jacket 65 or crankcase intake manifold cooling jacket 64. This will insure that the intake charge will not be cooled when the engine is not at an elevated temperature and thus avoids the likelihood of condensation and promotes quick warmup. Under this condition, water circulated by the coolant pump 68 will be bypassed through a bypass passageway 88 in which a flow restricting orifice 89 is positioned back to the expansion chamber 63 for return to the body of water in which the watercraft is operating. If a high pressure tends to develop in the cooling jackets, this pressure will be relieved by opening of the pressure responsive valve 87, as is well known in this art. However, once the engine and specifically the cylinder head 34 is at an elevated temperature, then the thermostatic valve 86 will open, and flow through the cooling jackets will occur in the direction shown in FIG. 3 when operating at low throttle openings or at the position shown in FIG. 4 when operating under high throttle opening high load conditions.

In the embodiment of the invention shown in the figures, the water supply comprises the body of water in which the watercraft operates. Water is drawn in from the body of water through the water intake port 70 by the water pump 68 in the lower unit 20 of the driveshaft housing 16. After traveling through one of the two possible water flow pathways (described above), the water is finally discharged from the engine through the water exhaust passage 80. The invention, however, is not limited to such an arrangement. A closed water system could also be employed with the temperature control system of the invention. In such a closed system, water is circulated through the system once, and then is cooled as it is passed through a heat exchange arrangement, before being recirculated through the temperature control system again.

Also shown in the embodiment of the figures, the initial warming of the water under low load operating conditions takes place in the water jackets 60 and 64 which are located in proximity to the combustion chamber and exhaust manifold. It is to be understood, however, that this warming operation could be effected in any region of the engine which has a relatively high operating temperature with respect to the rest of the engine.

The foregoing descriptions represent merely exemplary embodiments of the invention. Furthermore, although the invention is described herein within the context of outboard marine drive units, the invention is not limited to such an application. One reasonably skilled in the art will readily recognize that the invention is equally applicable to other engine arrangements having liquid operated temperature control systems. Finally, various changes or modifications may be made in said embodiments without departing from the spirit or scope of the invention.

I claim:

1. A temperature control system for a liquid cooled internal combustion engine comprising: a water pathway extending along two water-jacketed engine portions, and a water supply control means for selectively directing water into one of two possible flow paths within said water pathway, wherein a first flow path leads initially to a first water jacket located around a first engine portion and subsequently to a second water jacket located around a second engine portion, and a second flow path leads initially to said second water jacket around said second engine portion and subsequently to said first water jacket around said first engine portion.

2. The temperature control system of claim 1 wherein said first engine portion is a high temperature operating region of said engine and said second engine portion is a cooler operating region of said engine, so that when water flows along said first flow path it is warmed in the first water jacket before flowing next to said second water jacket.

3. The temperature control system of claim 2 wherein said water supply control means comprises a circuit having an engine load condition detection means for determining which of said two flow paths is to be supplied with said water according to the detected engine load condition.

4. The temperature control system of claim 3 wherein said circuit further comprises a positionable switchover valve connecting a water supply passage to said first flow path in a first switchover valve position and to said second flow path in a second switchover valve position.

5. The temperature control system of claim 4 wherein said circuit further comprises a control unit for controlling a valve operating device which positions said switchover valve responsive to the engine load condition detected by said engine load condition detection means.

6. The temperature control system of claim 5 wherein said internal combustion engine is a two-cycle engine employed as a power unit in a propulsion arrangement for a marine watercraft.

7. The temperature control system of claim 6 wherein a water inlet port is located in communication with a body of water within which said marine watercraft operates.

8. The temperature control system of claim 7 wherein a water pump is located along said water supply passage between said water inlet port and said switchover valve.

9. The temperature control system of claim 8 wherein said positionable switchover valve further connects said first flow path to a water exhaust passage when in said first switchover valve position and connects said second flow path to said water exhaust passage when in said second switchover valve position.

10. The temperature control system of claim 9 wherein said first engine portion is a combustion chamber.

11. The temperature control system of claim 10 wherein said second engine portion is an induction chamber.

12. The temperature control system of claim 10 wherein the second engine portion is a crankcase chamber.

13. The temperature control system of claim 12 further including means for delivering a charge to the crankcase chamber.

14. The temperature control system of claim 13 wherein the second water jacket further surrounds the means for delivering a charge to the crankcase chamber.

15. A liquid cooled, two cycle, crankcase compression, internal combustion engine comprising a cylinder head cylinder block assembly having a first cooling jacket and combustion chamber, and a crankcase chamber having a second cooling jacket, means for admitting a charge to said crankcase chamber, scavenge passage means for transferring said charge from said crankcase chamber to said combustion chamber, and means for circulating coolant between said first and said second cooling jackets.

16. A liquid cooled internal combustion engine comprising a cylinder head cylinder block assembly having a first cooling jacket and a crankcase chamber having a second cooling jacket, and means for circulating coolant between said first and said second cooling jackets, the means for circulating coolant through said first and second cooling jackets selectively controlling the flow from said first cooling jacket to said second cooling jacket or from said second cooling jacket to said first cooling jacket.

17. A liquid cooled internal combustion engine of claim 16 further including engine condition responsive means for switching the direction of flow between the first and second cooling jackets in response to an engine condition.

18. A liquid cooled internal combustion engine of claim 17 wherein the engine condition is load.

19. A liquid cooled internal combustion engine of claim 18 wherein the engine load is sensed by determining the position of a throttle valve in the induction system.

* * * * *